US012110623B2

(12) United States Patent
Hoerr et al.

(10) Patent No.: US 12,110,623 B2
(45) Date of Patent: Oct. 8, 2024

(54) SEWING OR STITCHING STATION AND APPARATUS AND METHOD FOR FEEDING PLATE-SHAPED FUNCTIONAL ELEMENTS TO A SEWING OR STITCHING MACHINE

(71) Applicant: ZSK Stickmaschinen GmbH, Krefeld (DE)

(72) Inventors: Melanie Hoerr, Krefeld (DE); Michael Metzler, Krefeld (DE); Thomas Wolters, Schwalmtal (DE); Philipp Scheiner, Weil der Stadt (DE); Rainer Holz, Marbach (DE)

(73) Assignee: ZSK Stickmaschinen GmbH, Krefeld (DE)

( * ) Notice: Subject to any disclaimer, the term of this patent is extended or adjusted under 35 U.S.C. 154(b) by 0 days.

(21) Appl. No.: 17/933,172

(22) Filed: Sep. 19, 2022

(65) Prior Publication Data

US 2024/0044060 A1 Feb. 8, 2024

(30) Foreign Application Priority Data

Sep. 23, 2021 (DE) ..... 102021210635.8

(51) Int. Cl.
*D05B 3/22* (2006.01)
*D05B 27/00* (2006.01)
*D05B 33/00* (2006.01)

(52) U.S. Cl.
CPC ..... *D05B 3/22* (2013.01); *D05B 27/00* (2013.01); *D05B 33/006* (2013.01); *D05D 2303/18* (2013.01); *D05D 2303/40* (2013.01)

(58) Field of Classification Search
CPC ..... D05B 33/006; D05B 27/00; D05B 39/00; D05B 3/12; D05B 3/22; D05D 2303/112; D05D 2303/18
USPC ..... 112/88, 113
See application file for complete search history.

(56) References Cited

U.S. PATENT DOCUMENTS 3,363,805 A * 1/1968 Prezes ..... D05B 3/22 112/113
3,483,833 A * 12/1969 Conner, Jr. ..... D05B 3/22 112/113
4,436,041 A * 3/1984 Taddicken ..... D05B 3/22 112/113
4,690,077 A * 9/1987 Nirenberg ..... D05B 3/22 112/113

(Continued)

*Primary Examiner* — Danny Worrell
(74) *Attorney, Agent, or Firm* — Maginot, Moore & Beck, LLP

(57) ABSTRACT

An apparatus for feeding plate-shaped functional elements to a sewing or stitching machine comprises a first guide rail which extends in a longitudinal direction between a first end and a second end and which has a first delimiting surface and a first guide surface extending transversely with respect to the first delimiting surface, a second guide rail which extends in the longitudinal direction between a first end and a second end and which has a second delimiting surface, facing the first delimiting surface and extending parallel to the first delimiting surface, and a second guide surface extending transversely with respect to the second delimiting surface in the direction of the first guide rail; and a transporting device configured to move a functional element resting on the first and the second guide surface from the first end of the guide rails in the direction of the second end of the guide rails.

18 Claims, 7 Drawing Sheets

(56) References Cited

U.S. PATENT DOCUMENTS

| | | | | | |
|---|---|---|---|---|---|
| 4,807,546 | A * | 2/1989 | Lenson | B65C 5/00 | 112/113 |
| 5,035,192 | A * | 7/1991 | Nirenberg | D05B 3/22 | 112/113 |
| 5,415,117 | A * | 5/1995 | Eisenkolb | D05B 3/22 | 112/113 |
| 5,562,057 | A * | 10/1996 | Lenson | D05B 3/12 | 112/113 |
| 5,755,168 | A * | 5/1998 | Gunther | D05C 7/08 | 112/113 |
| 7,082,884 | B2 * | 8/2006 | Tajima | D05C 7/08 | 112/113 |
| 7,293,512 | B2 * | 11/2007 | Tajima | D05C 7/08 | 112/99 |
| 7,334,533 | B2 * | 2/2008 | Tajima | D05C 7/08 | 112/113 |
| 7,370,590 | B2 * | 5/2008 | Tajima | D05C 7/08 | 112/113 |
| 8,495,962 | B2 * | 7/2013 | Li | D05B 35/06 | 112/113 |

* cited by examiner

A - A

SEWING OR STITCHING STATION AND APPARATUS AND METHOD FOR FEEDING PLATE-SHAPED FUNCTIONAL ELEMENTS TO A SEWING OR STITCHING MACHINE

DESCRIPTION OF THE INVENTION

The invention provides an apparatus for feeding plate-shaped functional elements to a sewing or stitching machine, a sewing or stitching station and a method for feeding plate-shaped functional elements to a sewing or stitching machine.

According to a first aspect of the invention, an apparatus for feeding plate-shaped functional elements, in particular separated or individual functional elements, to a sewing or stitching machine comprises a first guide rail which extends in a longitudinal direction between a first end and a second end and which has a first delimiting surface and a first guide surface extending transversely with respect to the first delimiting surface, a second guide rail which extends in the longitudinal direction between a first end and a second end and which has a second delimiting surface, facing the first delimiting surface and extending parallel to the first delimiting surface, and a second guide surface extending transversely with respect to the second delimiting surface in the direction of the first guide rail, and a transporting device configured to move a functional element resting on the first and the second guide surface from the first end of the guide rails in the direction of the second end of the guide rails.

By way of example, the first and the second guide rail may each be formed with an L-shaped cross section, wherein a first limb of the L-shaped cross section, said first limb being oriented for example in a vertical direction, forms or has the respective delimiting surface, and a limb of the L profile extending in a transverse direction forms or has the respective guide surface. The vertical direction extends transversely with respect to the longitudinal direction. The transverse direction extends transversely with respect to the longitudinal direction and transversely with respect to the vertical direction. The guide surfaces are thus configured to support the plate-shaped functional element in relation to the vertical direction, and the delimiting surfaces are configured to guide the functional element in relation to the transverse direction. The guide surfaces and the delimiting surfaces together form a guideway extending in the longitudinal direction.

According to a second aspect of the invention, a sewing or stitching station comprises a sewing or stitching machine having a needle for guiding a yarn, said needle being able to be moved up and down in a vertical direction, a clamping frame for clamping and holding a textile, said clamping frame being able to be moved transversely with respect to the vertical direction, and an apparatus according to the first aspect of the invention, wherein the guide rails and the needle are arranged on the same side of the clamping frame in relation to the vertical direction, and wherein the second end of the guide rails is arranged in the region of the needle or can be moved towards and away from the needle.

According to a third aspect of the invention, a method for feeding plate-shaped functional elements to a sewing or stitching machine comprises arranging a functional element on a guideway which extends in a longitudinal direction and which is defined, in relation to a transverse direction extending transversely with respect to the longitudinal direction, by mutually opposite first and second delimiting surfaces and, in relation to a vertical direction extending transversely with respect to the longitudinal direction and with respect to the transverse direction, by first and second guide surfaces arranged spaced apart from one another, wherein the functional element is arranged in such a way that a yarn penetration point of the functional element lies between the first and the second guide surface in relation to the transverse direction, and moving the functional element to an end of the guideway by means of a transporting device, such that the yarn penetration point of the functional element is arranged opposite to a needle of the sewing or stitching machine in relation to the vertical direction.

The method according to the third aspect of the invention can be carried out, for example, on the sewing or stitching station according to the second aspect of the invention and by means of an apparatus according to the first aspect of the invention.

According to a fourth aspect of the invention, a method for fastening a functional element to a textile comprises arranging the functional element on the textile, by means of an apparatus for feeding functional elements, in such a way that the functional element is located between a needle of a sewing or stitching machine in relation to a vertical direction, and a yarn penetration point of the functional element is positioned opposite to a needle in relation to the vertical direction. By way of example, this step may be effected using an apparatus according to the first aspect of the invention and/or this step may comprise carrying out the method according to the third aspect of the invention. In a further step, a first fixation or a first fixing of the functional element to the textile is generated by using the needle to pass a yarn through the yarn penetration point and through the textile. Directly before and/or during and/or directly after the first fixation of the functional element has been generated, the functional element is moved out of a guideway of the guide rails of the apparatus, for example by virtue of a stop of the apparatus releasing the functional element. By way of example, the first and second rails forming the guideway or the guide surfaces guiding the functional element may be retracted transversely with respect to the vertical direction, and/or the textile may be moved by means of a clamping frame in such a way as to pull the functional element out of the guideway. In a further step, fastening or further fixing of the functional element to the textile is effected by using the needle to pass the yarn through further yarn penetration points and through the textile while the functional element is being moved out of the guideway of the apparatus. The further stitching or sewing of the functional element to the textile is thus effected at the same time as the moving of the functional element out of the guideway, which advantageously results in a time saving. Furthermore, the functional element is thus still at least partially guided during the fastening operation, thus making exact orientation of the functional element easier.

One idea on which the invention is based is that of using a transporting device to actively feed individual or individualized plate-shaped functional elements, for example small rigid plates, via a guideway defined by rails which are situated opposite one another to a sewing or stitching machine. This means that a respective functional element is inserted into the guideway and transported, by means of the transporting device, to the end of the guideway, where it is taken up by a needle of the sewing or stitching machine and where the needle guides a yarn through the functional element so as to connect the latter to a textile situated below the guideway in relation to the vertical direction.

An advantage of the invention is that the functional element is supported in relation to the vertical direction by the first and the second guide surface as far as the end of the guideway or as far as the position where it is intended to be sewn to the textile. As a result, tilting of the functional elements during the displacement along the guideway is advantageously counteracted. The first and the second delimiting surface prevent unwanted rotation of the functional element, such that the functional element can be more easily positioned in the desired orientation relative to the needle and to the textile. Since the first and the second guide surface are arranged spaced apart from one another, a free space, through which the needle can affix the functional element to the textile, extends between said guide surfaces at least at the second end of the guide rails. As a result, preliminary fixation of the functional element to the textile can be effected while the functional element is still being held by the guide surfaces and the delimiting surfaces, which makes even more exact positioning and orientation of the functional element easier.

Advantageous configurations and refinements emerge from the description with reference to the figures of the drawing.

According to some embodiments, provision may be made for the first guide rail to have a third guide surface facing the first guide surface and extending parallel to the first guide surface, with the result that the first and the third guide surface form a guide groove which extends in the longitudinal direction and which is open in the direction of the second guide rail. By way of example, the first guide surface may be formed on a lower web, and the third guide surface may be formed on an upper web, which is situated opposite the lower web in relation to the vertical direction, of the first guide rail. It is thus possible for the first guide rail to have a U-shaped profile at least in certain portions. Due to this additional third guide surface, the functional element is guided between the first and the third guide surface in relation to the vertical direction. As a result, tilting of the functional element is further counteracted.

According to some embodiments, provision may be made for the third guide surface to extend, in relation to the longitudinal direction, from the second end of the first guide rail and to end spaced apart from the first end of the first guide rail. The guideway is thus open in the region of the first end of the first guide rail, which makes the positioning of the functional element easier. Since, however, the functional element is held by the first and the third guide surface at least at the second end of the first guide rail, the functional element is prevented from lifting off or tilting when the needle is moved back from the textile and the functional element again.

According to some embodiments, provision may be made for the second guide rail to have a fourth guide surface facing the second guide surface and extending parallel to the second guide surface, with the result that the second and the fourth guide surface form a guide groove which extends in the longitudinal direction and which is open in the direction of the first guide rail. By way of example, the second guide surface may be formed on a lower web, and the fourth guide surface may be formed on an upper web, which is situated opposite the lower web in relation to the vertical direction, of the second guide rail. It is thus possible for the second guide rail to have a U-shaped profile at least in certain portions. Due to this additional fourth guide surface, the functional element is guided between the second and the fourth guide surface in relation to the vertical direction. As a result, tilting of the functional element is further counteracted.

According to some embodiments, provision may be made for the fourth guide surface to extend, in relation to the longitudinal direction, from the second end of the second guide rail and to end spaced apart from the first end of the second guide rail. The guideway is thus open in the region of the second end of the second guide rail, which makes the positioning of the functional element easier. Particularly if the first guide rail also has a third guide surface ending spaced apart from the first end thereof, as described above, it is possible, in the region of the first end of the guide rails, for a functional element to be placed onto the first and the second guide surfaces from above in relation to the vertical direction in a very simple manner. Since, however, the functional element is held by the second and the fourth guide surface at least at the second end of the second guide rail, the functional element is prevented from lifting off or tilting when the needle is moved back from the textile and the functional element again.

According to some embodiments, provision may be made for the apparatus to have a stop which is arranged at the second end of the first guide rail and/or at the second end of the second guide rail and which can be moved transversely with respect to the longitudinal direction between a blocking position, in which the stop projects into a first half-space delimited by the first delimiting surface and the first guide surface or projects into a second half-space delimited by the second delimiting surface and the second guide surface, and a releasing position, in which the stop is retracted from the respective half-space. It is for example possible for the stop to be able to be moved in the transverse direction and/or in the vertical direction. In order to move the stop, provision may be made of an actuator, for example a linear motor or a pneumatic actuator, for example in combination with a spring which preloads the stop into the releasing position. The stop affords the advantage that automated, exact positioning of the functional element at the second end of the guide rails is made easier.

According to some embodiments, provision may be made for the transporting device to have a slide for displacing a respective functional element along the guide rails, said slide being able to be moved linearly along the longitudinal direction. It is for example possible for the slide to be moved back and forth along the guide rails by means of an actuator. A wide variety of possibilities are conceivable for the implementation of the actuator, for example a linear motor, a pneumatic cylinder, a spindle drive or the like. A slide affords the advantage that it is of robust configuration and operates in a reliable manner.

According to some embodiments, provision may be made for the apparatus to have a magazine which is arranged in the region of the first end of the guide rails and which has a receiving space for receiving a multiplicity of functional elements in an arrangement stacked one above the other and a separating device for removing the functional elements from the receiving space one at a time and for transferring the removed functional element to the transporting device. By way of example, the magazine may be arranged, in relation to the vertical direction, in the region of the first end of the guide rails, above the first and second guide surfaces, such that a functional element can be placed directly from the magazine onto the guide surfaces. As a result, a rapid and reliable feed of the functional elements to the guide rails is made easier.

According to some embodiments, provision may be made for the magazine to have a receiving housing defining the receiving space and a discharge opening of the receiving space, wherein the separating device has a first circulating conveyor belt with teeth and a second circulating conveyor belt with teeth, wherein a first portion of the first conveyor belt runs parallel to a second portion of the second conveyor belt, and wherein the first and the second portion are arranged opposite one another at the discharge opening, such that a functional element at the discharge opening can be received between two adjacent teeth of the first conveyor belt and between two adjacent teeth of the second conveyor belt and can be transported to a transfer point situated facing away from the discharge opening by means of the conveyor belts. It is for example possible for each conveyor belt to be guided around two spaced-apart deflection rollers, of which at least one can be driven. A region of the conveyor belt that extends between the deflection rollers forms the respective first or second portion. The teeth of the conveyor belts are external, with the result that the teeth of the first conveyor belt in the first portion face the teeth of the second conveyor belt in the second portion. The conveyor belts may be arranged, in relation to the vertical direction, for example between the discharge opening and the first and second guide surfaces of the guide rails. The separating apparatus implemented by way of the conveyor belts affords the advantage that a reliable removal of individual printed circuit boards is simplified. A change in the functional element output rate is also variable in a simple manner by changing the conveying speed of the conveyor belts. Furthermore, a distance between the first portion of the first conveyor belt and the second portion of the second conveyor belt may be variable, thus making the adaptation of the magazine to different sizes of functional elements easier.

According to some embodiments, provision may be made for the magazine to have, as separating device, a first circulating conveyor belt with teeth and a second circulating conveyor belt with teeth, wherein a first portion of the first conveyor belt runs parallel to a second portion of the second conveyor belt, and wherein the first and the second portion are arranged opposite one another and define the receiving space of the magazine, wherein, along the first and the second portion, a multiplicity of functional elements can be received between in each case two adjacent teeth of the first conveyor belt and two adjacent teeth of the second conveyor belt and can be transported to a transfer point by means of the conveyor belts. The conveyor belts can fundamentally be configured as described above. However, according to these embodiments, provision is made for the conveyor belts themselves to form the receiving containers or to define the receiving space. It is thus advantageously possible to reduce the number of parts. A further advantage is that a distance between the first portion of the first conveyor belt and the second portion of the second conveyor belt may be variable, thus making the adaptation of the magazine to different sizes of functional elements easier. The conveyor belts may be arranged, in relation to the vertical direction, for example above the first and second guide surfaces of the guide rails.

According to some embodiments, provision may be made for the functional element to comprise a printed circuit board and an electronic circuit, in particular a sensor circuit, formed on the printed circuit board.

According to some embodiments, provision may be made for the yarn penetration point to be formed by a through-opening. This is advantageous in particular in the case of rigid printed circuit boards, since damage to the printed circuit boards or to the yarn is prevented in this way. At the same time, the risk of displacement or tilting of the functional element during the penetration of the needle is reduced.

According to some embodiments, provision may be made for the method to additionally comprise fixing the functional element to a textile arranged below the guide surfaces in relation to the vertical direction by using the needle to pass a yarn through the yarn penetration point and through the textile.

According to some embodiments, provision may be made, during the fastening of the functional element to the textile, for the functional element to first be fastened to the textile at a first row of yarn penetration points, which extends along a longitudinal direction of the guideway, and to subsequently be fastened to the textile at a second row of yarn penetration points, which extends along a transverse direction of the guideway. This additional stitching along a second direction achieves an areal fixation of the functional element and further prevents tilting of the functional element.

According to some embodiments, the method for fastening the functional element to the textile may furthermore comprise electrical contacting of the functional element by means of a conductive yarn. By way of example, the functional element may be in the form of a printed circuit board and may have a multiplicity of electrical contacting points in the form of yarn penetration points. For the electrical contacting, the needle can be used to pass a conductive yarn, wire or mixture through these contacting points and the textile.

According to a further aspect of the present disclosure, a magazine for an apparatus for feeding plate-shaped functional elements to a sewing or stitching machine is provided. The magazine comprises a receiving space for receiving a multiplicity of functional elements in an arrangement stacked one above the other and a separating device for removing the functional elements from the receiving space one at a time.

According to a first alternative, provision may be made for the magazine to have a receiving housing defining the receiving space and a discharge opening of the receiving space, wherein the separating device has a first circulating conveyor belt with teeth and a second circulating conveyor belt with teeth, wherein a first portion of the first conveyor belt runs parallel to a second portion of the second conveyor belt, and wherein the first and the second portion are arranged opposite one another at the discharge opening, such that a functional element at the discharge opening can be received between two adjacent teeth of the first conveyor belt and between two adjacent teeth of the second conveyor belt and can be transported to a transfer point situated facing away from the discharge opening by means of the conveyor belts. It is for example possible for each conveyor belt to be guided around two spaced-apart deflection rollers, of which at least one can be driven. A region of the conveyor belt that extends between the deflection rollers forms the respective first or second portion. The teeth of the conveyor belts are external, with the result that the teeth of the first conveyor belt in the first portion face the teeth of the second conveyor belt in the second portion. The separating apparatus implemented by way of the conveyor belts affords the advantage that a reliable removal of individual printed circuit boards is simplified. A change in the functional element output rate is also variable in a simple manner by changing the conveying speed of the conveyor belts.

According to a second alternative, provision may be made for the magazine to have, as separating device, a first circulating conveyor belt with teeth and a second circulating conveyor belt with teeth, wherein a first portion of the first conveyor belt runs parallel to a second portion of the second conveyor belt, and wherein the first and the second portion are arranged opposite one another and define the receiving space of the magazine, wherein, along the first and the second portion, a multiplicity of functional elements can be received between in each case two adjacent teeth of the first conveyor belt and two adjacent teeth of the second conveyor belt and can be transported to a transfer point which faces away by means of the conveyor belts. The conveyor belts can fundamentally be configured as described above. However, according to the present alternative, provision is made for the conveyor belts themselves to form the receiving containers or to define the receiving space. It is thus advantageously possible to reduce the number of parts. A further advantage is that a distance between the first portion of the first conveyor belt and the second portion of the second conveyor belt may be variable, thus making the adaptation of the magazine to different sizes of functional elements easier. The conveyor belts may be arranged, in relation to the vertical direction, for example above the first and second guide surfaces of the guide rails.

The features and advantages disclosed herein in connection with one aspect of the invention or disclosure are also disclosed for the respectively other aspects.

DESCRIPTION OF THE FIGURES

The invention will be explained below with reference to the figures of the drawings. In the figures.

In the figures, the same reference designations denote identical or functionally identical components, unless stated otherwise.

DETAILED DESCRIPTION

Figure 1:
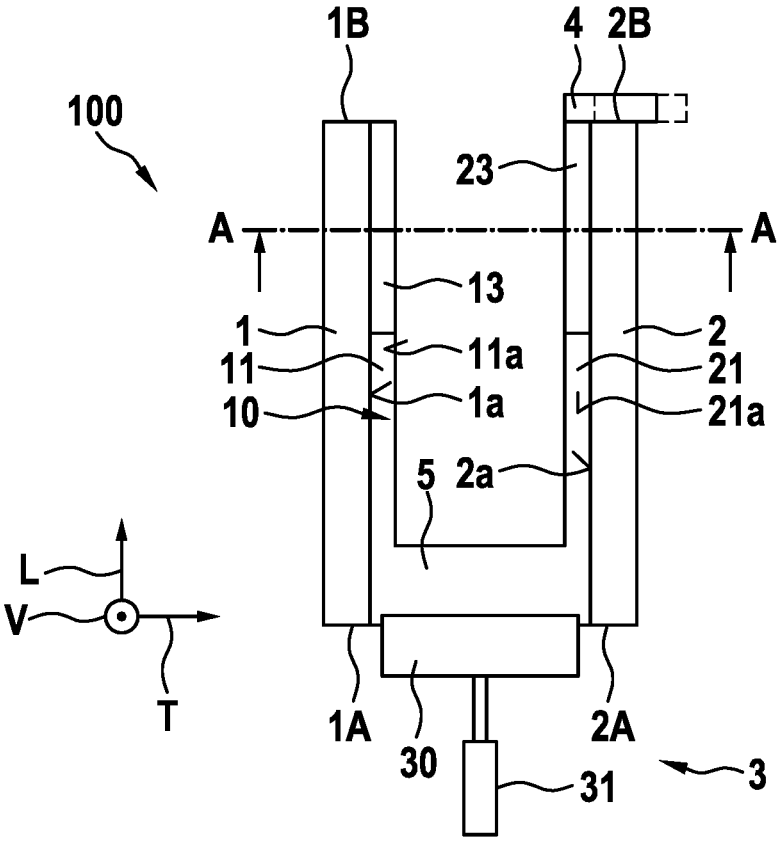
FIG. 1 shows a plan view of an apparatus for feeding plate-shaped functional elements to a sewing or stitching machine according to one exemplary embodiment of the invention.
Figure 2:
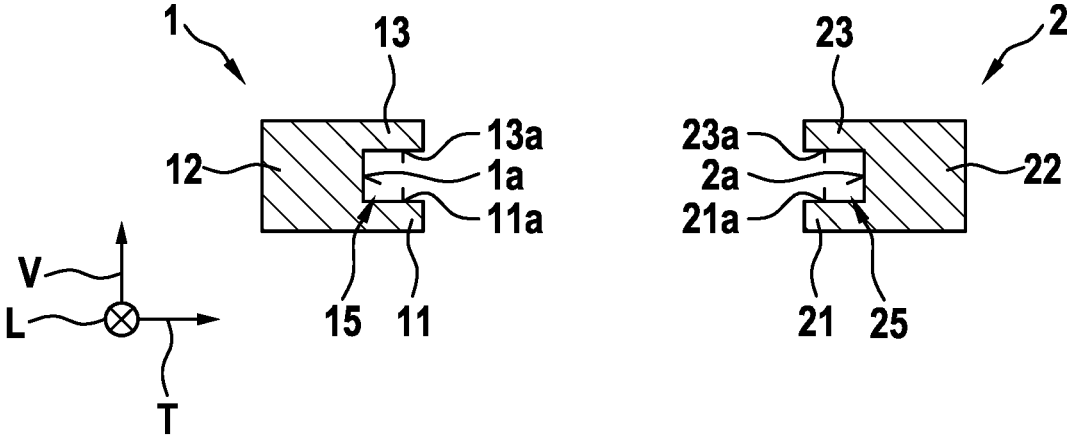
FIG. 2 shows a broken-away sectional view of the apparatus shown in FIG. 1 that results from a section along line A-A shown in FIG. 1.

FIG. 1 schematically shows a plan view of an apparatus 100 for feeding plate-shaped functional elements 40 to a sewing or stitching machine 200. FIG. 2 shows a sectional view of the apparatus shown in FIG. 1. As shown by way of example in FIG. 1, the apparatus 100 has a first guide rail 1, a second guide rail 2, a transporting device 3 and an optional stop 4.

As schematically illustrated in FIG. 1, the first guide rail 1 and the second guide rail 2 each extend between a first end 1A, 2A and a second end 1B, 2B in a longitudinal direction L and are arranged spaced apart from one another in relation to a transverse direction T extending transversely with respect to the longitudinal direction L. As can be seen in FIGS. 1 and 2, it is for example possible for each guide rail 1, 2 to have a base carrier 12, 22, for example of rectangular cross section, and a first web 11, 21 which protrudes from the base carrier 12, 22 in the transverse direction T. Optionally, a respective second web 13, 23 may additionally be provided, which likewise protrudes from the base carrier 12, 22 in the transverse direction T and is arranged spaced apart from the respective first web 11, 12 in relation to a vertical direction V extending transversely with respect to the longitudinal direction L and with respect to the transverse direction T, as is shown by way of example in FIG. 2. FIGS. 1 and 2 show merely by way of example that a second web 13, 23 is formed both on the first and on the second guide rail 1, 2. However, it is also conceivable for only one of the guide rails 1, 2 to have a second web 13, 23. As schematically illustrated in FIG. 1, provision may in particular be made for the second web 13, 23 to extend from the second end 1B, 2B of the respective guide rail 1, 2 and to end spaced apart from the first end 1A, 2A. As furthermore illustrated by way of example in FIG. 1, the first and the second guide rail 1, 2 may optionally be connected by a transverse web 5 which extends between the guide rails 1, 2 in the region of the first end 1A, 2A of the guide rails 1, 2.

As shown in FIGS. 1 and 2, the first guide rail 1 has a first delimiting surface 1*a* and a first guide surface 11*a*. The first delimiting surface 1*a* and the first guide surface 11*a* extend transversely with respect to one another, such that they delimit an L-shaped half-space. As shown by way of example in FIGS. 1 and 2, the first delimiting surface 1*a* may extend, for example, along the longitudinal direction L and along the vertical direction V. The first delimiting surface 1*a* may be configured in particular on the base carrier 12 of the first guide rail 1. The first guide surface 11*a* may extend, for example, along the longitudinal direction L and along the transverse direction T and may be configured in particular on the first web 11 of the first guide rail 1, as is shown by way of example in FIGS. 1 and 2. An optional third guide surface 13*a* of the first guide rail 1 faces the first guide surface 11*a* and extends parallel to the first guide surface 11*a*. As shown in FIG. 2, the third guide surface 13*a* may be configured, for example, on the second web 13 of the first guide rail 1. It is thus possible for the third guide surface 13*a* to extend, in relation to the longitudinal direction L, from the second end 1B of the first guide rail 1 and to end spaced apart from the first end 1A of the first guide rail 1. As schematically illustrated in FIG. 2, the first and the third guide surface 11*a*, 13*a* form, together with the first delimiting surface 1*a*, a guide groove 15 which extends in the longitudinal direction L and which is open in the transverse direction T.

As shown in FIGS. 1 and 2, the second guide rail 2 has a second delimiting surface 2*a* and a second guide surface 21*a*. The second delimiting surface 2*a* and the second guide surface 21*a* extend transversely with respect to one another, such that they delimit an L-shaped half-space. As shown by way of example in FIGS. 1 and 2, the second delimiting surface 2*a* may extend, for example, along the longitudinal direction L and along the vertical direction V. The second delimiting surface 2*a* may be configured in particular on the base carrier 22 of the second guide rail 2. The second guide surface 21*a* may extend, for example, along the longitudinal direction L and along the transverse direction T and may be configured in particular on the second web 21 of the second guide rail 2, as is shown by way of example in FIGS. 1 and 2. An optional fourth guide surface 23*a* of the second guide rail 2 faces the second guide surface 21*a* and extends parallel to the second guide surface 21*a*. As shown in FIG. 2, the fourth guide surface 23*a* may be configured, for example, on the second web 23 of the second guide rail 2. It is thus possible for the fourth guide surface 23*a* to extend, in relation to the longitudinal direction L, from the second end 2B of the second guide rail 2 and to end spaced apart from the first end 2A of the second guide rail 2. As schematically illustrated in FIG. 2, the second and the fourth guide surface 21*a*, 23*a* form, together with the second delimiting surface 2*a*, a guide groove 25 which extends in the longitudinal direction L and which is open in the transverse direction T.

As can be seen in FIGS. 1 and 2, the first and the second delimiting surface 1*a*, 2*a* are oriented facing one another or are arranged opposite one another in relation to the transverse direction T. The first and the second guide surface 11*a*, 21*a* may be arranged in particular at the same level or be oriented in alignment in relation to the vertical direction V. As schematically illustrated in FIGS. 1 and 2, the guide surfaces 11*a*, 21*a*, 13*a*, 23*a* and the delimiting surfaces 1*a*, 2*a* are preferably of planar configuration. In general, the guide rails 1, 2 define a guideway 10 which extends in the longitudinal direction L and which is defined, in relation to the transverse direction T, by the mutually opposite first and second delimiting surfaces 1*a*, 2*a* and, in relation to the vertical direction V, by the first and second guide surfaces 11*a*, 21*a* arranged spaced apart from one another in the transverse direction T.

As shown schematically and merely by way of example in FIG. 1, the transporting device 3 may have a slide 30. The slide 30 can be moved back and forth linearly along the longitudinal direction L in the guideway 10. In order to move the slide 30, it is for example possible to provide an actuator 31 which may be implemented, for example, in the form of a pneumatic cylinder, as is symbolically illustrated in FIG. 1. A functional element 40 placed onto the guide surfaces 11*a*, 21*a* in the region of the first end 1A, 2A of the guide rails 1, 2 can be displaced to the second end 1B, 2B of the guide rails 1, 2 and be positioned there by movement of the slide 30 along the longitudinal direction L.

The transporting device 3 is not limited to a slide 30, but can also be implemented in another way. In general, the transporting device 3 is configured to move a functional element 40 resting on the first and the second guide surface 11*a*, 21*a* from the first end 1A, 2A of the guide rails 1, 2 in the direction of the second end 1B, 2B of the guide rails 1, 2.

The optional stop 4 is illustrated in merely symbolic fashion in the form of a block in FIG. 1. As shown by way of example in FIG. 1, the stop 4 may be arranged at the second end 2B of the second guide rail 2. It goes without saying that the stop 4 may also be arranged at the second end 1B of the first guide rail 1, or it is conceivable for a respective stop 4 to be arranged both at the second end 1B of the first guide rail 1 and at the second end 2B of the second guide rail 2. The stop 4 can be moved, for example along the transverse direction T and/or along the vertical direction V, between a blocking position and a releasing position. In FIG. 1, the stop 4 is illustrated in a blocking position by solid lines, and in a releasing position by dashed lines. As schematically shown in FIG. 1, in the blocking position, the stop 4 projects into the second half-space delimited by the second delimiting surface 2*a* and the second guide surface 21*a*. If the stop is arranged on the first guide rail 1, it projects, in the blocking position, into the first half-space delimited by the first delimiting surface 1*a* and the first guide surface 11*a*. In the releasing position, the stop 4 is retracted from the respective half-space, as is schematically shown in FIG. 1.

Figure 3:
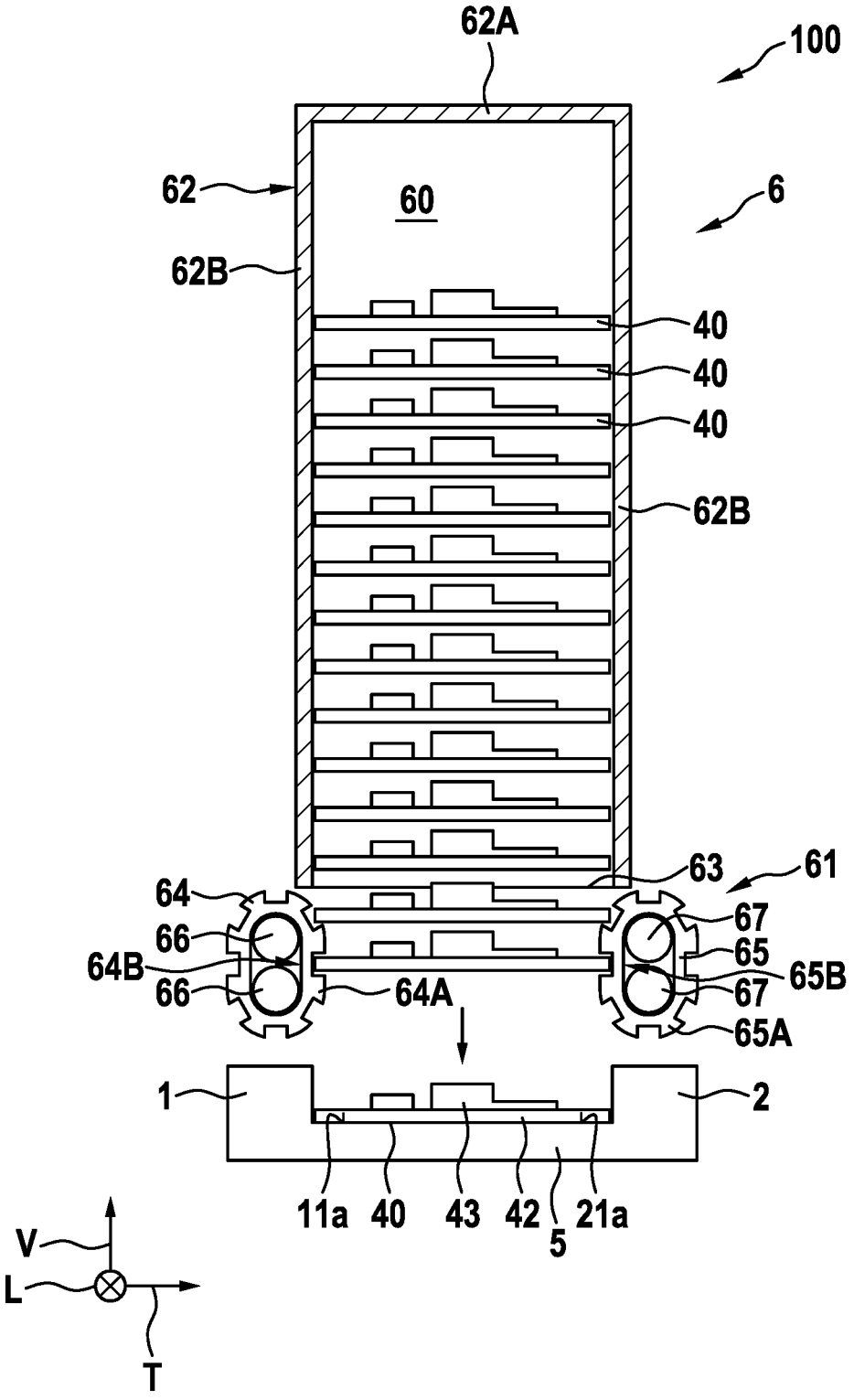
FIG. 3 shows a sectional view of an apparatus for feeding plate-shaped functional elements to a sewing or stitching machine according to one exemplary embodiment of the invention.

FIG. 3 schematically shows a magazine 6 for an apparatus 100 for feeding plate-shaped functional elements 40 to a sewing or stitching machine 200. By way of example, the above-described apparatus 100 may comprise the magazine 6. However, it is also possible for the magazine 6 to be used for differently constructed apparatuses for feeding plate-shaped functional elements 40 to a sewing or stitching machine 200.

As schematically illustrated in FIG. 3, the magazine 6 has a receiving housing 62 and a separating device 61. The receiving housing 62 defines a receiving space 60 and has a discharge opening 63. By way of example, the housing 62 may have a bottom or an end wall 62A and a plurality of side walls 62B extending therefrom, wherein the bottom 62A and the side walls 62B define the interior space or receiving space 60 and the discharge opening 63 arranged opposite to the bottom 62A. As schematically illustrated in FIG. 3, a multiplicity of plate-shaped functional elements 40 stacked one above the other may be received in the receiving space 60.

The separating apparatus 61 shown by way of example in FIG. 3 has a first conveyor belt 64 and a second conveyor belt 65. The conveyor belts 64, 65 each have a multiplicity of protruding webs or teeth 64A, 65A, wherein a respective intermediate space is formed between two adjacent teeth 64A, 65A of the respective conveyor belt 64, 65. The teeth 64A, 65A are each spaced apart from one another in such a way that an end portion of the functional element 40 can be received and/or fixed between two adjacent teeth 64A, 65A. The conveyor belts 64, 65, including the teeth 64A, 65A, may be formed, for example, from a plastics material, in particular a rubber material.

As illustrated schematically and merely by way of example in FIG. 3, the first conveyor belt 64 may be deflected at two mutually spaced-apart rollers 66, wherein at least one of the rollers 66 may be coupled to a drive (not shown), for example an electric motor. Between the rollers 66, the first conveyor belt 64 forms a rectilinear first portion 64B. In a similar manner, the second conveyor belt 65 may be deflected at two mutually spaced-apart rollers 67, as schematically illustrated in FIG. 3, wherein at least one of the rollers 67 may be coupled to a drive (not shown), for example an electric motor. Between the rollers 67, the second conveyor belt 65 forms a rectilinear second portion 65B. In principle, it would also be conceivable for the respective conveyor belt 64, 65 to be deflected at more than two rollers 66, 67. In general, each conveyor belt 64, 65 has a rectilinear portion 64B, 65B. As is furthermore shown in FIG. 3, the first portion 64B of the first conveyor belt 64 and the second portion 65B of the second conveyor belt 65 are arranged opposite one another and run parallel to one another. The rollers 66 and the rollers 67 can be driven in opposite directions of rotation, such that, in the first and the second portion 64B, 65B, the teeth 64A, 65A can be moved in the same direction in a synchronous manner.

Furthermore, the first and the second portion 64B, 65B extend from the discharge opening 63 of the housing 62. As schematically illustrated in FIG. 3, it is thus possible, at the discharge opening 63, for a functional element 40 to be received with a first edge region between two adjacent teeth 64A of the first conveyor belt 64 and with a second edge region between two adjacent teeth 65A of the second conveyor belt 65 and to be transported to a transfer point situated facing away from the discharge opening 63 by means of the conveyor belts 64, 65. At the end of the first and the second portion 64B, 65B, the conveyor belts 64, 65 are deflected at the respective roller 66, 67, such that the teeth 64A, 65A are laterally removed from the edge regions of the functional element 40 and the functional element 40 is released.

As shown schematically and by way of example in FIG. 3, the magazine 6 may be arranged, in relation to the vertical direction V, opposite to the first and second guide surfaces 11*a*, 21*a*, in particular in the region of the first end 1A, 2A of the guide rails 1, 2. In this case, the first portion 64A of the first conveyor belt 64 and the second portion 65A of the second conveyor belt 65 extend in the vertical direction V and the rollers 66 are spaced apart from one another in the vertical direction V, and the rollers 67 are likewise spaced apart from one another in the vertical direction V. In this way, the functional elements 40 can be removed individually from the magazine 6, in particular from the receiving space 60, and be inserted directly into the guideway 10.

Figure 4:
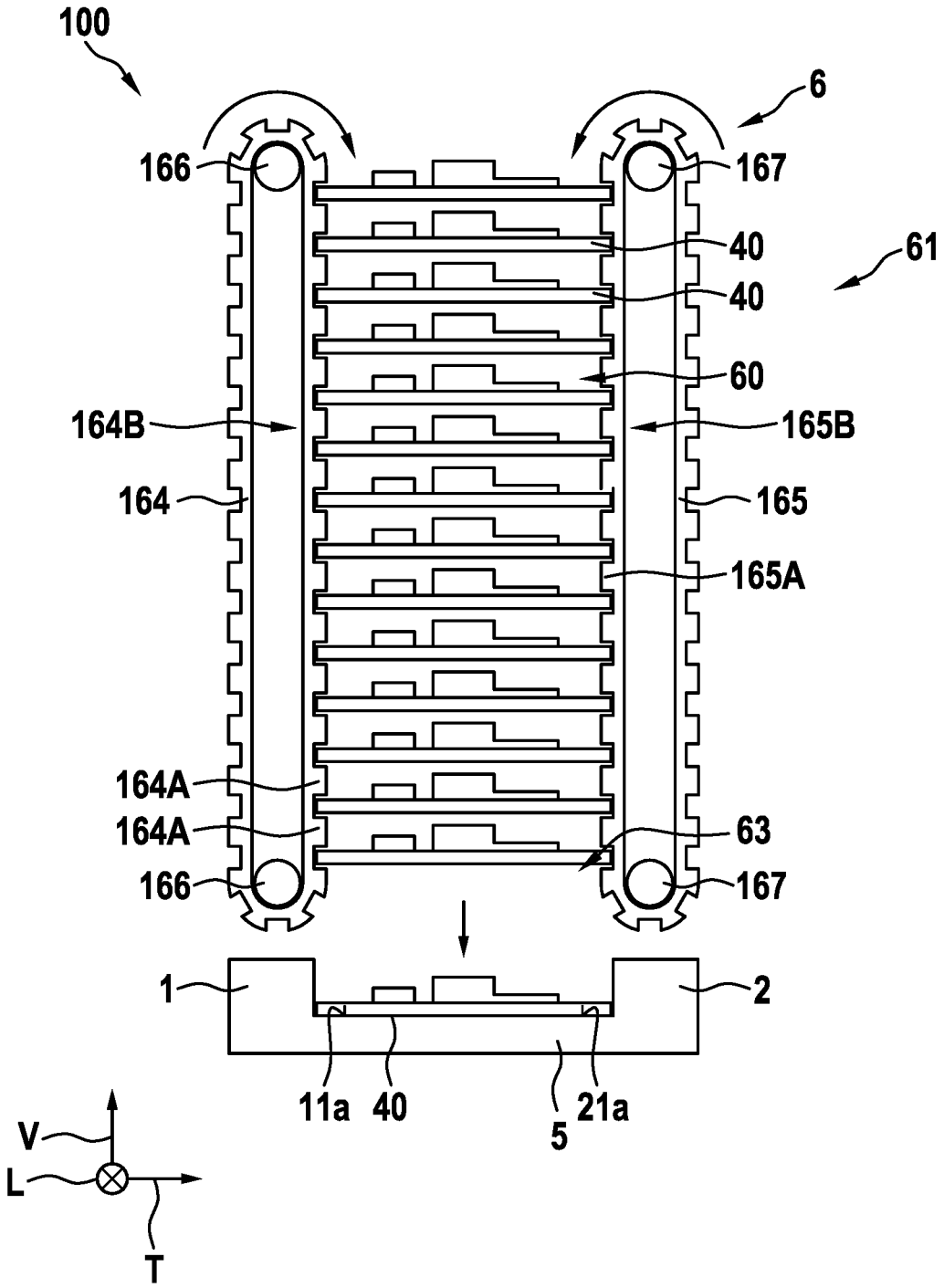
FIG. 4 shows a sectional view of an apparatus for feeding plate-shaped functional elements to a sewing or stitching machine according to one exemplary embodiment of the invention.

FIG. 4 illustrates a further magazine 6 for an apparatus 100 for feeding plate-shaped functional elements 40 to a sewing or stitching machine 200. By way of example, the above-described apparatus 100 may comprise the magazine 6. However, it is also possible for the magazine 6 to be used for differently constructed apparatuses for feeding plate-shaped functional elements 40 to a sewing or stitching machine 200.

Similar to that in FIG. 3, the magazine 6 shown in FIG. 4 comprises a receiving space for receiving a multiplicity of functional elements 40 in an arrangement stacked one above the other and a separating device 61 for removing the functional elements 40 from the receiving space 60 one at a time. In contrast to FIG. 3, however, the receiving space 60 is not defined by a housing, but rather the separating device 61 has a first conveyor belt 164 and a second conveyor belt 165, between which the receiving space 60 is defined.

As is schematically illustrated in FIG. 4, the conveyor belts 164, 165 each have a multiplicity of protruding webs or teeth 164A, 165A, wherein a respective intermediate space is formed between two adjacent teeth 164A, 165A of the respective conveyor belt 164, 165. The teeth 164A, 165A are each spaced apart from one another in such a way that an end portion of the functional element 40 can be received and/or fixed between two adjacent teeth 164A, 165A. The conveyor belts 164, 165, including the teeth 164A, 165A, may be formed, for example, from a plastics material, in particular a rubber material.

As illustrated schematically and merely by way of example in FIG. 4, the first conveyor belt 164 may be deflected at two mutually spaced-apart rollers 166, wherein at least one of the rollers 166 may be coupled to a drive (not shown), for example an electric motor. Between the rollers 166, the first conveyor belt 164 forms a rectilinear first portion 164B. In a similar manner, the second conveyor belt 165 may be deflected at two mutually spaced-apart rollers 167, as schematically illustrated in FIG. 4, wherein at least one of the rollers 167 may be coupled to a drive (not shown), for example an electric motor. Between the rollers 167, the second conveyor belt 65 forms a rectilinear second portion 165B. In principle, it would also be conceivable for the respective conveyor belt 164, 165 to be deflected at more than two rollers 166, 167. In general, each conveyor belt 164, 165 has a rectilinear portion 164B, 165B. As is furthermore shown in FIG. 4, the first portion 164B of the first conveyor belt 164 and the second portion 165B of the second conveyor belt 165 are arranged opposite one another and run parallel to one another. The receiving space 60 of the magazine 6 is thus defined between the conveyor belts 164, 165. The rollers 166 and the rollers 167 can be driven in opposite directions of rotation, such that, in the first and the second portion 164B, 165B, the teeth 164A, 165A can be moved in the same direction in a synchronous manner.

As schematically illustrated in FIG. 4, a functional element 40 can be received with a first edge region between two adjacent teeth 164A of the first conveyor belt 164 and with a second edge region between two adjacent teeth 165A of the second conveyor belt 165. A multiplicity of teeth 164A, 165A are provided along the first and the second portion 164B, 165B, such that a multiplicity of functional elements 40 can be received between in each case two adjacent teeth 164A of the first conveyor belt 164 and two adjacent teeth 165A of the second conveyor belt 165.

As shown schematically and merely by way of example in FIG. 4, the magazine 6 may be arranged, in relation to the vertical direction V, opposite to the first and second guide surfaces 11*a*, 21*a*, in particular in the region of the first end 1A, 2A of the guide rails 1, 2. In this case, the first portion 164A of the first conveyor belt 164 and the second portion 165A of the second conveyor belt 165 extend in the vertical direction V and the rollers 166 are spaced apart from one another in the vertical direction V, and the rollers 167 are likewise spaced apart from one another in the vertical direction V. In order to discharge a functional element 40 in an individual manner, the rollers 166 and 167 are rotated in opposite directions of rotation. At the end of the first and the second portion 164B, 165B, the conveyor belts 164, 65 are deflected at the respective roller 166, 167, such that the teeth 164A, 165A are laterally removed from the edge regions of the functional element 40 and the functional element 40 is released. In this way, the functional elements 40 can be removed individually from the magazine 6, in particular from the receiving space 60, and be inserted, for example, directly into the guideway 10, as is schematically illustrated in FIG. 4.

Figure 5:
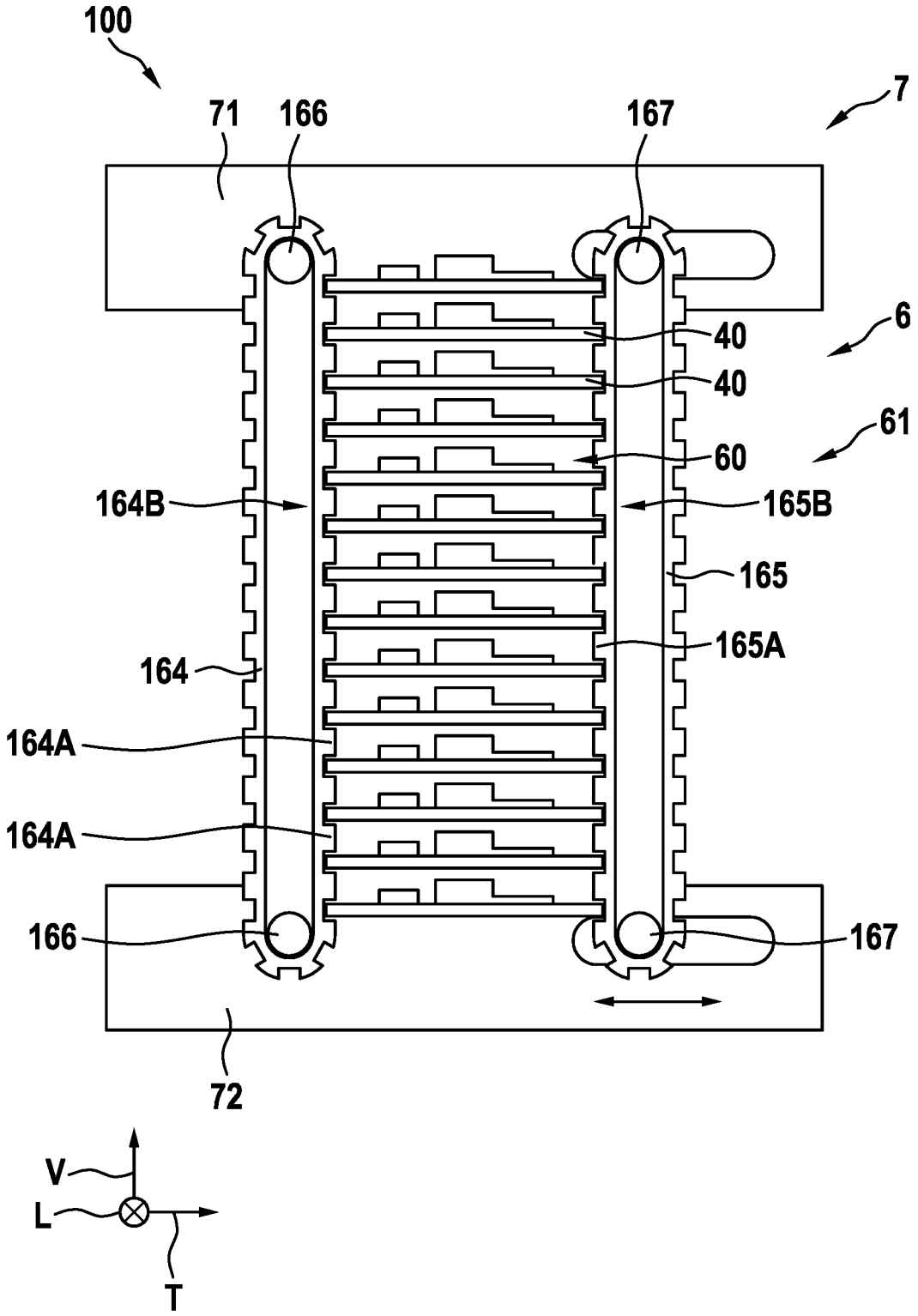
FIG. 5 shows a sectional view of a magazine for an apparatus according to one exemplary embodiment of the invention.

As schematically illustrated in FIG. 5, the magazine 6 shown in FIG. 4 may optionally additionally have a carrying frame 7. The carrying frame 7 may have a first carrying device 71, for example in the form of a carrying profile, and a second carrying device 72 which is arranged spaced apart from said first carrying device and which may for example likewise be in the form of a carrying profile. A first one of the rollers 166 at which the first conveyor belt 164 is deflected is mounted on the first carrying device 71, and a second one of the rollers 166 at which the first conveyor belt 164 is deflected is mounted on the second carrying device 72. Similarly, a first one of the rollers 167 at which the second conveyor belt 165 is deflected is mounted on the first carrying device 71, and a second one of the rollers 167 at which the second conveyor belt 165 is deflected is mounted on the second carrying device 72. The first and the second portion 164B, 165B thus extend between the carrying devices 71, 72. As schematically illustrated in FIG. 5, the rollers 167 may be mounted on the respective carrying device 71, 72, for example in a slot 73, 74 as schematically shown in FIG. 5, so as to be displaceable relative to the rollers 166, such that a distance between the rollers 166, 167, and thus a distance between the first portion 164B of the first conveyor belt 164 and the second portion 165B of the second conveyor belt 165, is variable. In this way, the adaptation of the dimensions of the receiving space 60 to different sizes of functional elements 40 is made easier.

Figure 6:
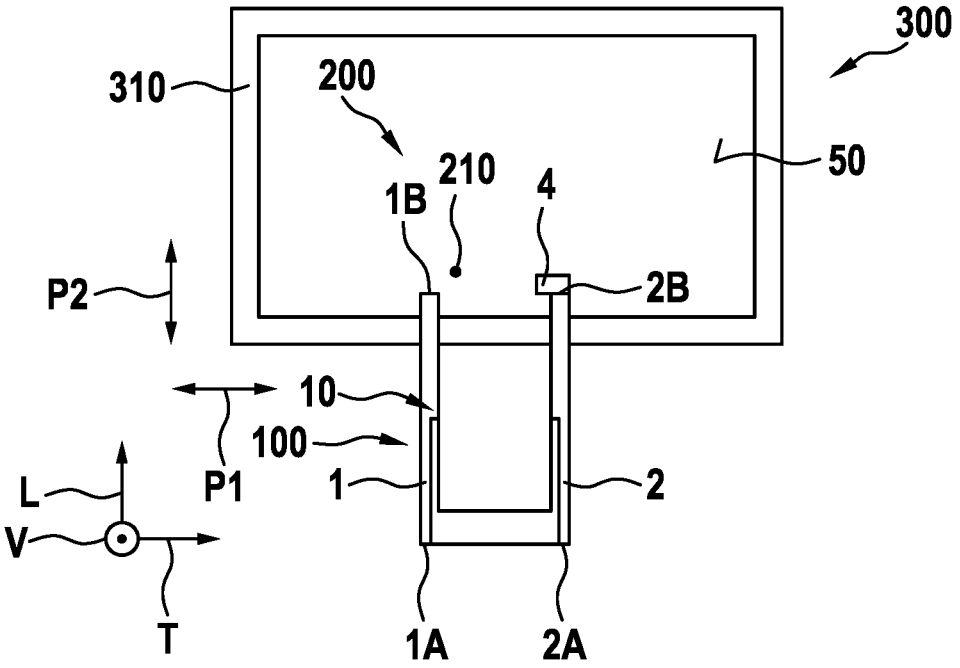
FIG. 6 shows a plan view of a sewing or stitching system according to one exemplary embodiment of the invention.

FIG. 6 illustrates a plan view of a sewing or stitching station 300 in merely schematic fashion. The sewing or stitching station 300 comprises a sewing or stitching machine 200, a clamping frame 310 and an apparatus 100 for feeding plate-shaped functional elements 40 (not shown in FIG. 6), as has been described above. The sewing or stitching machine 200 has a needle 210 for guiding a yarn G, said needle being able to be moved up and down in the vertical direction V. The needle 210 is illustrated in FIG. 6 in merely symbolic fashion in the form of a dot. The clamping frame 310 is configured to clamp and hold a textile 50 and may be, for example, of rectangular form. The clamping frame 310 can be moved, by way of a displacement mechanism (not shown), transversely with respect to the vertical direction V, for example along the longitudinal direction L and/or along the transverse direction T, as is symbolized by the arrows P1 and P2 in FIG. 6. As schematically illustrated in FIG. 6, the guide rails 1, 2 and the needle 210 are arranged on the same side of the clamping frame 310 in relation to the vertical direction V, and the second end 1B, 2B of the guide rails 1, 2 is arranged in the region of the needle 210 or can be moved towards and away from the needle 210. The textile 50 clamped in the clamping frame 310 is thus arranged on a side of the guide rails 1, 2 that is situated facing away from the first and second guide surfaces 11*a*, 21*a*. The guide rails 1, 2 may also be positionable relative to the needle 210 in such a way that said needle is arranged, in relation to the longitudinal direction L, between the first and the second end 1A, 2A, 1B, 2B of the guide rails 1, 2 and, in relation to the transverse direction T, between the first and the second guide rail 1, 2. It is thus possible for the functional element 40 to be fixed to the textile 50 by means of at least one stitch by a thread G while said functional element is being held by the guide rails 1, 2.

FIGS. 7 to 10 illustrate by way of example a method for feeding plate-shaped functional elements 40 to a sewing or stitching machine 200. FIGS. 7 to 10 show merely by way of example that the method is carried out by means of the apparatus 100 shown in FIGS. 1 and 2. Therefore, in the following text reference is made to the apparatus 100 explained above.

Figure 7:
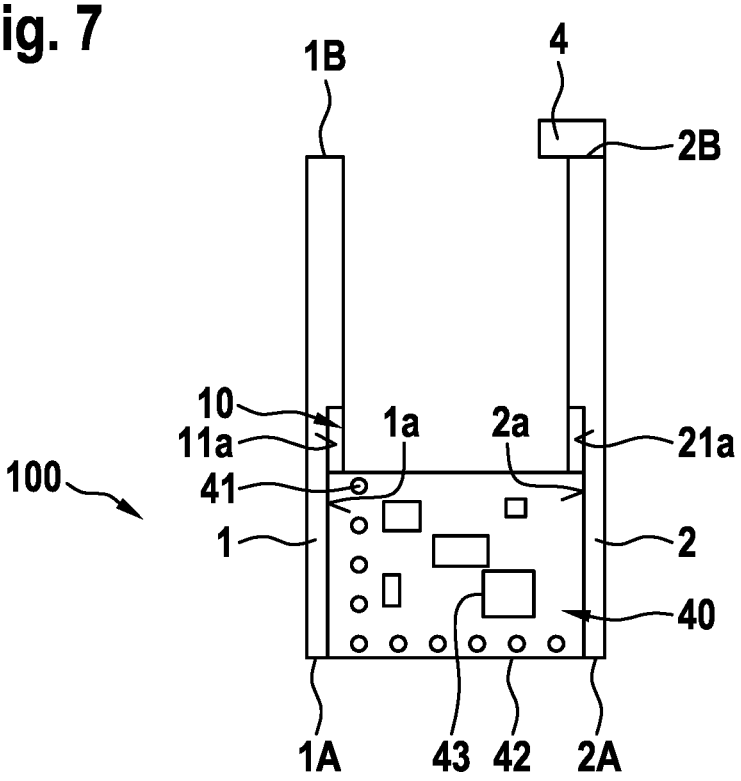
FIG. 7 shows a plan view of an apparatus for feeding plate-shaped functional elements to a sewing or stitching machine during a method according to one exemplary embodiment of the invention.

In a first step, a functional element 40 is arranged on the guideway 10. As schematically illustrated in FIG. 7, the functional element 40 is arranged, in relation to the transverse direction T, between the delimiting surfaces 1*a*, 2*a* and, in relation to the vertical direction V, on the first and second guide surfaces 11*a*, 21*a*. As schematically illustrated in FIG. 7, the functional element 40 may have, for example, a rectangular periphery, but is not limited thereto, rather may also have, for example, a hexagonal or another polygonal periphery. In general, the functional element 40 is in the shape of a plate. As furthermore shown in FIG. 7, the functional element 40 has at least one yarn penetration point 41 through which a yarn G is intended to be guided at a later stage in order to fasten the functional element 40 to the textile 50. As shown merely by way of example in FIG. 7, the yarn penetration point 41 may be formed, for example, by a through-opening. FIG. 7 schematically shows that a multiplicity of yarn penetration points 41 may be provided along the periphery of the functional element 40, for example along at least two adjoining sides of the polygon. As can furthermore be seen in FIG. 7, the functional element 40 is arranged on the guideway 10 in such a way that the yarn penetration point 41 of the functional element 40 lies between the first and the second guide surface 11*a*, 21*a* in relation to the transverse direction T. The arranging of the functional element 40 on the guideway 10 may comprise, for example, removing the functional element 40 from one of the magazines 6 shown in FIGS. 3 to 5, wherein the respective separating apparatus 61 removes the functional element 40 from the receiving space 60 of the magazine 6 and deposits it, preferably directly, on the guideway 10.

The functional element 40 may comprise in particular a printed circuit board 42 and an electronic circuit 43, for example a sensor circuit, formed on the printed circuit board 42, as is illustrated in merely schematic fashion in FIG. 7.

Figure 8:
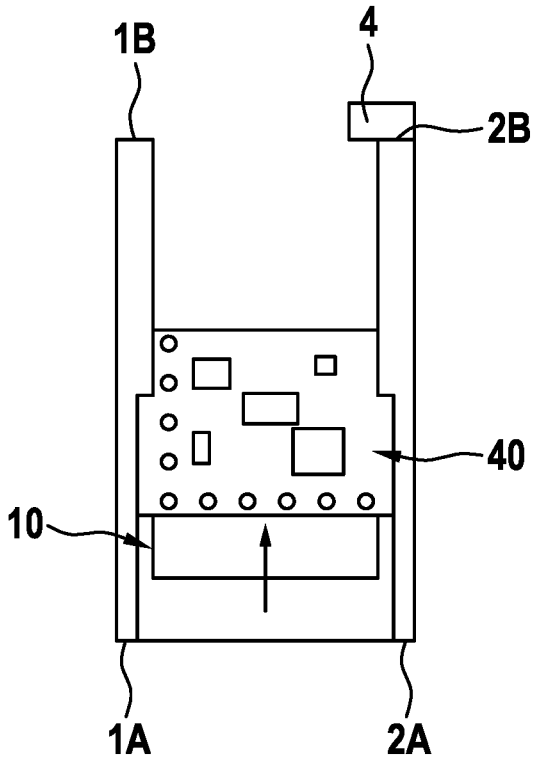
FIG. 8 shows the plan view shown in FIG. 7 during the method at a point in time after the point in time shown in FIG. 7.
Figure 9:
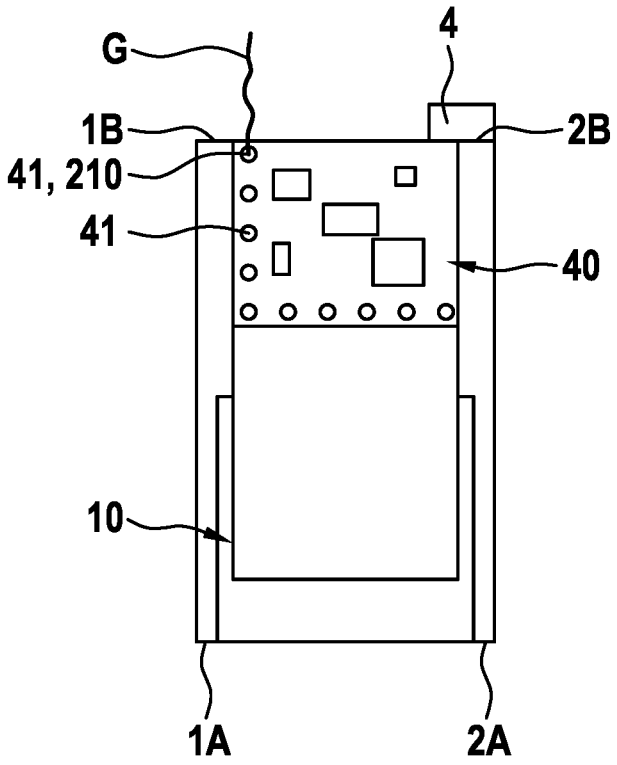
FIG. 9 shows the plan view shown in FIG. 7 during the method at a point in time after the point in time shown in FIG. 8.

As shown in FIGS. 8 and 9, in a further step, the functional element 40 is moved to the second end 1B, 2B of the guideway 10 or of the guide rails 1, 2 by means of the transporting device 3. By way of example, the slide 30 (not shown in FIGS. 7 to 10) may place the functional element 40 against the optional stop 4 located in its blocking position, as is schematically shown in FIG. 9. As a result, the yarn penetration point 41 of the functional element 40 is arranged opposite to a needle 210 of the sewing or stitching machine 200 in relation to the vertical direction V.

Figure 10:
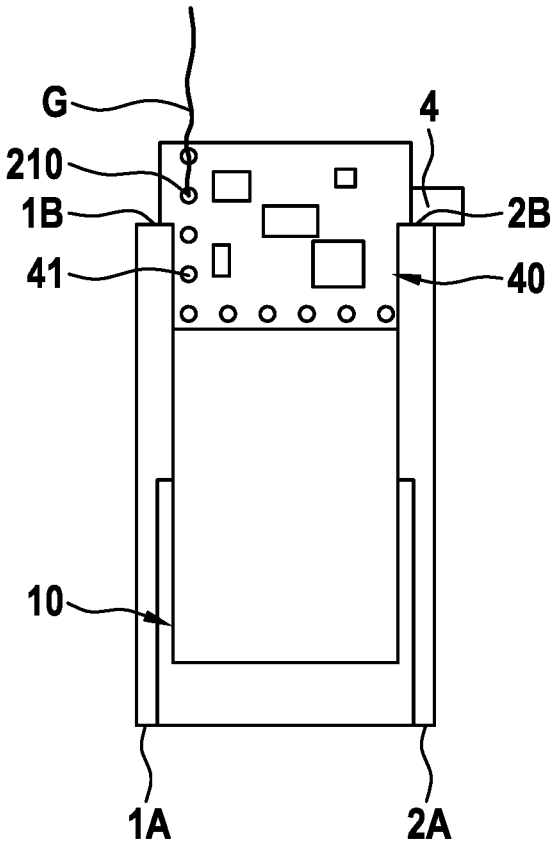
FIG. 10 shows the plan view shown in FIG. 7 during the method at a point in time after the point in time shown in FIG. 9.

In a further step, it is thus possible to fix the functional element 40 to a textile 50 arranged below the guide surfaces 11*a*, 21*a* in relation to the vertical direction V by using the needle 210 to pass a yarn through the yarn penetration point 41 and through the textile 50. In this way, the functional element 40 is stitched onto the textile 50. Before, during or directly after this fixation, the stop 4 is moved into its releasing position as is shown in FIG. 10. The textile 50 can furthermore be moved further in the longitudinal direction L, for example by means of the clamping frame 310 (FIG. 6), as a result of which the functional element 40 is moved beyond the end 1B, 2B of the guideway 10 or of the guide rails 1, 2 until a further yarn penetration point 41 is arranged opposite to the needle 210 and can be fixed to the textile by way of the yarn G with the aid of the needle 210.

The described method for feeding plate-shaped functional elements 40 to the sewing or stitching machine 200 may in particular be part of a method for fastening functional elements 40 to a textile 50. By way of example, the functional element 40 may be arranged or positioned on the textile 50 by means of the above-described method. As part of the feeding method or as part of the method for fastening of the functional element 40, a first fixation of the functional element 40 to the textile 50 is initially generated by using the needle 210 to pass a yarn through the yarn penetration point 41 and through the textile 50. Furthermore, directly before and/or during and/or directly after the first fixation of the functional element 40, the functional element 40 is moved out of the guideway 10, in particular by virtue of the optional stop 4 releasing the functional element 40. At the same time as this, the functional element 40 is fixed or fastened to the textile 50 at further yarn penetration points 41 by using the needle 210 to pass the yarn through the further yarn penetration points 41 and through the textile 50. By way of example, the fastening may initially be effected along a first row of yarn penetration points 41, which are oriented along the longitudinal direction L. By way of example, the feeding apparatus 100 may be retracted and/or raised as soon as the functional element 40 has been fixed along this first row and thus positioned fixedly in terms of rotation. Subsequently, the functional element 40 can be fixed to the textile 50 in a second row of yarn penetration points 41 which runs transversely or in an angled manner with respect to the first row, wherein the second row may extend, for example, in the transverse direction T. This additional stitching along a second direction achieves an areal fixation of the functional element 40 and further prevents tilting of the functional element 40. In an optional, further method step, the functional element 40 is electrically contacted by means of a conductive yarn.

Although the present invention has been explained above in exemplary fashion on the basis of exemplary embodiments, it is not limited thereto, but rather can be modified in various ways. In particular, combinations of the above-mentioned exemplary embodiments are also conceivable.

The invention claimed is:

1. An apparatus for feeding plate-shaped functional elements to a sewing or stitching machine, comprising:

a first guide rail which extends in a longitudinal direction between a first end and a second end and which has a first delimiting surface and a first guide surface extending transversely with respect to the first delimiting surface;

a second guide rail which extends in the longitudinal direction between a first end and a second end and which has a second delimiting surface, facing the first delimiting surface and extending parallel to the first delimiting surface, and a second guide surface extending transversely with respect to the second delimiting surface in the direction of the first guide rail; and a transporting device configured to move a functional element resting on the first and the second guide surface from the first end of the guide rails in the direction of the second end of the guide rails;

said apparatus further comprising;

a stop which is arranged at the second end of the first guide rail and/or at the second end of the second guide rail and which can be moved transversely with respect to the longitudinal direction between a blocking position, in which the stop projects into a first half-space delimited by the first delimiting surface and the first guide surface a or projects into a second half-space delimited by the second delimiting surface a and the second guide surface, and a releasing position, in which the stop is retracted from the respective half-space; and/or a magazine which is arranged in the region of the first end of the guide rails, and which has a receiving space for receiving a multiplicity of functional elements in an arrangement stacked one above the other and a separating device for removing the functional elements from the receiving space one at a time and for transferring the removed functional element to the transporting device, wherein the magazine has one or both of;

a receiving housing defining the receiving space and a discharge opening of the receiving space, and wherein the separating device has a first circulating conveyor belt with teeth and a second circulating conveyor belt with teeth, wherein a first portion of the first conveyor belt runs parallel to a second portion of the second conveyor belt, and wherein the first and the second portion are arranged opposite one another at the discharge opening, such that a functional element at the discharge opening can be received between two adjacent teeth of the first conveyor belt and between two adjacent teeth of the second conveyor belt and can be transported to a transfer point situated facing away from the discharge opening by means of the conveyor belts; and a first circulating conveyor belt with teeth and a second circulating conveyor belt with teeth, as separating device, wherein a first portion of the first conveyor belt runs parallel to a second portion of the second conveyor belt, and wherein the first and the second portion are arranged opposite one another and define the receiving space of the magazine, wherein, along the first and the second portion, a multiplicity of functional elements can be received between in each case two adjacent teeth of the first conveyor belt and two adjacent teeth of the second conveyor belt and can be transported to a transfer point by means of the conveyor belts.

2. The apparatus according to claim 1, wherein the first guide rail has a third guide surface facing the first guide surface and extending parallel to the first guide surface, with the result that the first and the third guide surface form a guide groove which extends in the longitudinal direction and which is open in the direction of the second guide rail.

3. The apparatus according to claim 2, wherein the third guide surface extends, in relation to the longitudinal direction, from the second end of the first guide rail and ends spaced apart from the first end of the first guide rail.

4. The apparatus according to claim 1, wherein the second guide rail has a fourth guide surface facing the second guide surface and extending parallel to the second guide surface, with the result that the second guide surface and the fourth guide surface form a guide groove which extends in the longitudinal direction and which is open in the direction of the first guide rail.

5. The apparatus according to claim 4, wherein the fourth guide surface extends, in relation to the longitudinal direction, from the second end of the second guide rail and ends spaced apart from the first end of the second guide rail.

6. The apparatus according to claim 1, additionally having:

a stop which is arranged at the second end of at least one of the first guide rail and the second guide rail and which can be moved transversely with respect to the longitudinal direction between a blocking position, in which the stop projects into one of a first half-space delimited by the first delimiting surface and the first guide surface and a second half-space delimited by the second delimiting surface and the second guide surface, and a releasing position, in which the stop is retracted from the respective first and second half-space.

7. The apparatus according to claim 1, wherein the transporting device has a slide for displacing a respective functional element along the first and second guide rails, said slide being able to be moved linearly along the longitudinal direction.

8. The apparatus according to claim 1, additionally having:

a magazine which is arranged in the region of the respective first end of the first and second guide rails and which has a receiving space for receiving a multiplicity of functional elements in an arrangement stacked one above the other and a separating device for removing the functional elements from the receiving space one at a time and for transferring the removed functional element to the transporting device.

9. The apparatus according to claim 8, wherein the magazine has a receiving housing defining the receiving space and a discharge opening of the receiving space, and wherein the separating device has a first circulating conveyor belt with teeth and a second circulating conveyor belt with teeth, wherein a first portion of the first conveyor belt runs parallel to a second portion of the second conveyor belt, and wherein the first and the second portion are arranged opposite one another at the discharge opening, such that a functional element at the discharge opening can be received between two adjacent teeth of the first conveyor belt and between two adjacent teeth of the second conveyor belt and can be transported to a transfer point situated facing away from the discharge opening by means of the conveyor belts.

10. The apparatus according to claim 8, wherein the magazine has, as the separating device, a first circulating conveyor belt with teeth and a second circulating conveyor belt with teeth, wherein a first portion of the first conveyor belt runs parallel to a second portion of the second conveyor belt, and wherein the first portion and the second portion are arranged opposite one another and define the receiving space of the magazine, wherein, along the first portion and the second portion, a multiplicity of functional elements can be received between in each case two adjacent teeth of the first conveyor belt and two adjacent teeth of the second conveyor belt and can be transported to a transfer point by means of the conveyor belts.

11. A sewing or stitching station, incorporating an apparatus according to claim 1 and further comprising:

a sewing or stitching machine having a needle for guiding a yarn, said needle configured and operable to be moved up and down in a vertical direction; and a clamping frame for clamping and holding a textile, said clamping frame configured and operable to be moved transversely with respect to the vertical direction;

wherein the first and second guide rails and the needle are arranged on the same side of the clamping frame in relation to the vertical direction; and wherein the respective second end of the first and second guide rails is arranged in the region of the needle or can be moved towards and away from the needle.

12. A method for feeding plate-shaped functional elements to a sewing or stitching machine by the apparatus of claim 1, comprising the steps of:

arranging a functional element on a guideway which extends in a longitudinal direction and which is defined, in relation to a transverse direction extending transversely with respect to the longitudinal direction, by said mutually opposite first and second delimiting surfaces and, in relation to a vertical direction extending transversely with respect to the longitudinal direction and with respect to the transverse direction, by said first and second guide surfaces arranged spaced apart from one another, wherein the functional element is arranged in such a way that a yarn penetration point of the functional element lies between the first and the second guide surface in relation to the transverse direction; and moving the functional element to an end of the guideway by means of said transporting device, such that the yarn penetration point of the functional element is arranged opposite to a needle of the sewing or stitching machine in relation to the vertical direction.

13. The method according to claim 12, wherein the functional element comprises a printed circuit board and an electronic circuit.

14. The method according to claim 12, wherein the yarn penetration point is formed by a through-opening.

15. The method according to claim 11, additionally comprising:

fixing the functional element to a textile arranged below the guide surfaces in relation to the vertical direction by using the needle to pass a yarn through the yarn penetration point and through the textile.

16. A method for fastening a functional element to a textile by the apparatus of claim 1, comprising the steps of:

arranging the functional element on the textile, by means of said apparatus for feeding the functional elements in such a way that the functional element is located between a needle of a sewing or stitching machine in relation to a vertical direction, and a yarn penetration point of the functional element is positioned opposite to the needle in relation to the vertical direction;

generating a first fixation of the functional element to the textile by using the needle to pass a yarn through the yarn penetration point and through the textile; and, directly before and/or during and/or directly after the first fixation of the functional element has been generated, moving the functional element out of a guideway of the apparatus, in particular by virtue of a stop of the apparatus releasing the functional element; and fastening the functional element to the textile by using the needle to pass the yarn through further yarn penetration points and through the textile while the functional element is being moved out of the guideway of the apparatus.

17. The method according to claim 13, wherein the yarn penetration point is formed by a through-opening.

18. The method according to claim 13, wherein the electronic circuit is a sensor circuit formed on the printed circuit board.

* * * * *